US007025492B2

(12) United States Patent
Dorsch et al.

(10) Patent No.: US 7,025,492 B2
(45) Date of Patent: Apr. 11, 2006

(54) STORAGE/TREATMENT TANK MIXING SYSTEM

(75) Inventors: Glenn R. Dorsch, Aberdeen, WA (US); Richard Behnke, Elgin, IL (US)

(73) Assignee: Vaughan Co., Inc., Montesano, WA (US)

( * ) Notice: Subject to any disclaimer, the term of this patent is extended or adjusted under 35 U.S.C. 154(b) by 0 days.

(21) Appl. No.: 10/858,859

(22) Filed: May 28, 2004

(65) Prior Publication Data

US 2005/0162972 A1 Jul. 28, 2005

Related U.S. Application Data

(63) Continuation of application No. 10/055,866, filed on Jan. 23, 2002, now abandoned.

(60) Provisional application No. 60/263,937, filed on Jan. 24, 2001, provisional application No. 60/299,609, filed on Jun. 19, 2001.

(51) Int. Cl.
*B01F 5/02* (2006.01)

(52) U.S. Cl. ..... 366/165.1; 366/173.2

(58) Field of Classification Search ..... 366/173.1, 366/173.2, 165.1, 165.5
See application file for complete search history.

(56) References Cited

U.S. PATENT DOCUMENTS

| | | | | |
|---|---|---|---|---|
| 981,098 | A * | 1/1911 | McCaskell | 422/224 |
| 1,992,261 | A | 2/1935 | Traudt | |
| 3,271,304 | A | 9/1966 | Valdespino et al. | |
| 3,586,294 | A | 6/1971 | Strong | |
| 3,893,924 | A | 7/1975 | Le Compte, Jr. et al. | |
| 4,097,026 | A | 6/1978 | Haindl | |
| 4,164,541 | A | 8/1979 | Platz et al. | |
| 4,206,052 | A | 6/1980 | Mandt | |
| 4,290,884 | A | 9/1981 | Mandt | |
| 4,372,851 | A | 2/1983 | Mandt | |
| 4,618,426 | A | 10/1986 | Mandt | |
| 4,812,045 | A | 3/1989 | Rivers | |
| 5,458,414 | A | 10/1995 | Crump et al. | |
| 5,810,473 | A | 9/1998 | Manabe et al. | |
| 6,109,778 | A | 8/2000 | Wilmer | |
| 6,217,207 | B1 * | 4/2001 | Streich et al. | 366/137 |

FOREIGN PATENT DOCUMENTS

CA 1 043 481 11/1978

(Continued)

OTHER PUBLICATIONS

Bathija, P.R. et al., "Jet Mixing," *Annual Meeting*, American Institute of Chemical Engineers, San Francisco, California, Nov. 29, 1979.

(Continued)

*Primary Examiner*—David Sorkin
(74) *Attorney, Agent, or Firm*—Christensen O'Connor Johnson Kindness PLLC

(57) ABSTRACT

Submerged jet nozzles are located at equal distances from the center of a tank containing a quantity of liquid and solids. Some of the nozzles induce flow partly inward and some induce flow partly outward, but all mixers are directed generally in the same circumferential direction. The inward directed nozzles are located close to the bottom of the tank and direct liquid across the central portion of the tank where solids tend to accumulate. Upper nozzles direct flow at least partly outward but in the same circumferential direction as the lower nozzles. The flow from the upper nozzles tends to reflect off the wall of the tank in addition to inducing a rotational flow of substantially the entire body of liquid in the tank.

6 Claims, 8 Drawing Sheets

FOREIGN PATENT DOCUMENTS

| | | | |
|---|---|---|---|
| DE | 726 101 | | 10/1942 |
| FR | 395 707 | | 12/1965 |
| GB | 2 058 597 | A | 4/1981 |
| SU | 734331 | | 5/1980 |
| WO | WO 97/41976 | * | 11/1997 |

OTHER PUBLICATIONS

Fluidyne shop drawing, Williamsburg, VA, Jan. 25, 1990.
Jet-Tech shop drawing, Joaquin Ranch, Mar. 23, 1982.
Jet-Tech shop drawing, Oklahoma City, OK, Mar. 23, 1985.
Commonwealth Engineers, Inc., shop drawing, Plymouth, Indiana, Nov. 1990.
Great lakes Aqua Store Systems, Inc., shop drawing, Indiana Packers, Sep. 24, 1990.
Biothane Corporation shop drawing, Digester Feed Distribution Piping, Pekin Energy Company, Mar. 2, 1988.
Vaughan Co., Inc., "Digester Mixing" sales brochure, Jan. 1999.
IPER, PCT/US02/03918, dated Aug. 23, 2004.

* cited by examiner

STORAGE/TREATMENT TANK MIXING SYSTEM

CROSS-REFERENCE TO RELATED APPLICATIONS

This application is a continuation of U.S. patent application Ser. No. 10/055,866, filed Jan. 23, 2002, now abandoned, which claims the benefit of U.S. Provisional Application No. 60/263,937, filed Jan. 24, 2001, and U.S. Provisional Application No. 60/299,609, filed Jun. 19, 2001.

FIELD OF THE INVENTION

The present invention relates to systems for mixing non-homogeneous material including liquids, and particularly mixtures of liquids and solids.

BACKGROUND OF THE INVENTION

In an anaerobic digester, for example, waste water and/or sewage is introduced into a large tank for storage and treatment. The waste water and/or sewage contains solid material more dense than the liquid and slurry with which it is carried, and such solid material tends to migrate toward the bottom of the tank. From time to time it is desirable to mix the settled solid material and the upper liquid or slurry for efficiency of the treating process, such as bacterial breakdown of the solids. In addition, when the tank is to be emptied, a more thorough and convenient emptying can be achieved if the solids are substantially uniformly suspended in the liquid.

The problem of uniform mixing of liquids and solids has been dealt with in the past, such as in the system of Crump et al. U.S. Pat. No. 5,685,076, and Crump et al. U.S. Pat. No. 5,548,414. In the systems disclosed in those patents, submerged propeller mixers or jet nozzles are asserted to induce a "helical" flow pattern in the tank which is claimed to be effective in achieving and maintaining uniform mixing.

Other mixing apparatus for liquid-solid slurries have been proposed, such as in the systems of Strong U.S. Pat. No. 3,586,294, and German patent No. 726101. These patents appear to be concerned with creating substantial turbulence by using mixing devices inducing flow in opposite directions circumferentially of a tank.

SUMMARY OF THE INVENTION

The present invention takes a novel approach to mixing solutions of liquids and solids by using submerged mixing apparatus, preferably jet nozzles, including a plurality of mixers preferably located at equal distances from the center of a tank, some inducing flow partially inward and some inducing flow partially outward, but all directed generally in the same direction circumferentially of a tank, i.e., all clockwise or all counterclockwise. The inward directed mixers preferably are located close to the bottom of the tank and force liquid to sweep generally across the central portion of the tank where solids tend to accumulate when a rotational flow in one circumferential direction is induced in a container. Upper mixers which preferably are positioned at the same distance from the center of the tank direct flow at least partially outward but in the same circumferential direction. The flow from the upper mixers tends to reflect off the wall of the tank in addition to, over time, inducing a rotational flow of substantially the entire body of slurry in the tank. Thus, even if substantial settling of material in a tank has occurred over a fairly long period, the solids that have settled in the bottom are thoroughly mixed with the thinner slurry or liquid toward the top. This is very effective for treating purposes, and also allows the tank to be thoroughly emptied.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
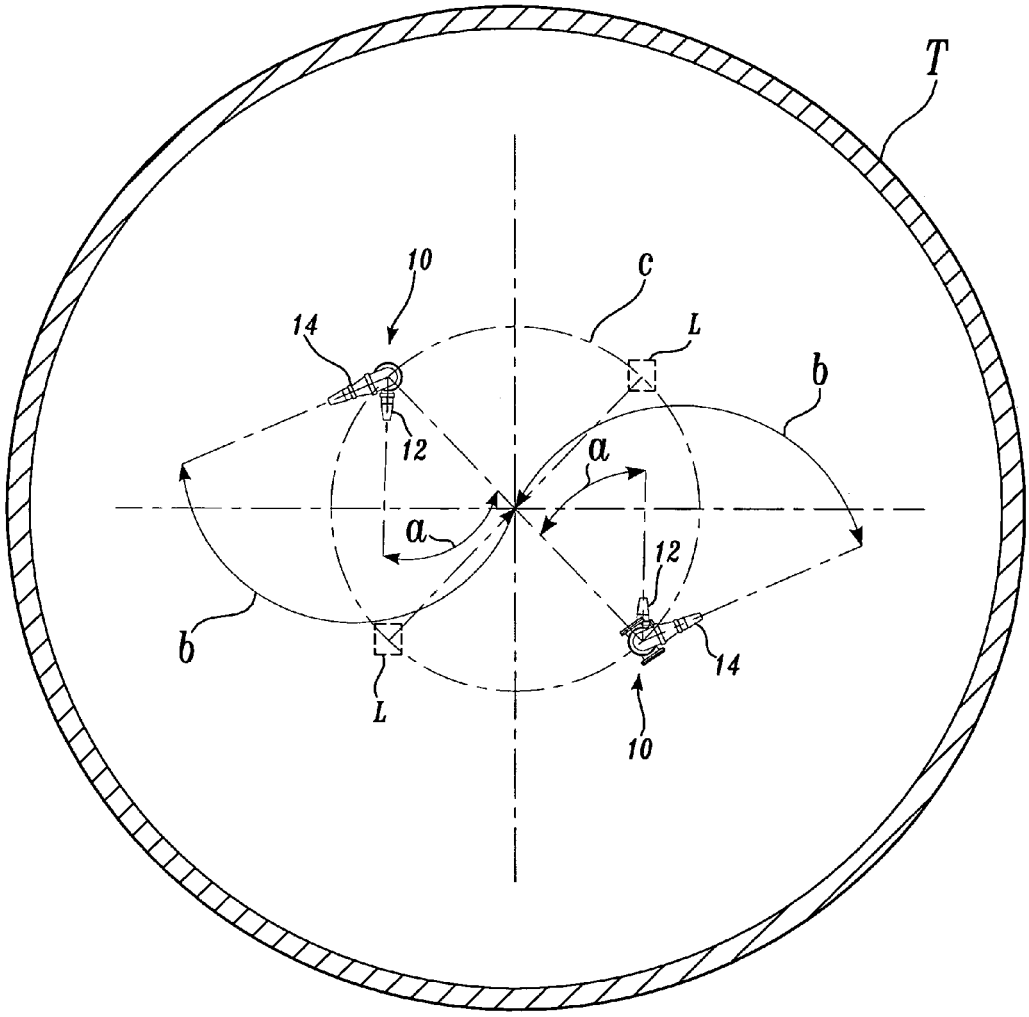
FIG. 1 is a diagrammatic top plan of a storage/treating tank mixing system in accordance with the present invention using a plurality of mixers in accordance with the present invention disposed opposite each other in a tank.

FIG. 1 illustrates a representative storage/treatment tank T of the type with which the present invention may be used. For an anaerobic digester containing wastewater and/or sewage, the tank typically will be 50–90 feet in diameter, although it could be as little as 40 feet or less in diameter or as great as 120 feet or more in diameter. The illustrated tank has a circular peripheral wall and is approximately 50 feet in diameter. The depth of the slurry in the tank can be about 20 feet, although much deeper tanks are known to be used. The floor of the tank may be inclined downward toward the center.

The mixing system in accordance with the present invention can use one or more mixer assemblies 10, preferably at least two mixers disposed at equal angles circumferentially of the tank. For example, when two mixer assemblies 10 are used, they will be located along a common diameter. In general, each mixer assembly includes a lower mixer 12 close to the bottom of the tank and an upper mixer 14 farther from the bottom of the tank. The lower mixers 12 induce flow at an angle a (relative to a radius intersecting the center of the tank and the mixer assembly 10) of less than 90 degrees, whereas the upper mixers 14 induce flow at an angle b (relative to the same radius) greater than 90 degrees. Nevertheless, each mixer 12, 14 induces flow in the same circumferential direction, such as counterclockwise as viewed in FIG. 1. An angle of 90 degrees for either angle a or angle b would be tangent to a circle c which defines the equidistant spacing of the mixer assemblies 10 from the center of the tank. Thus, the lower mixers 12 are referred to as inward directed and the upper mixers 14 are referred to as outward directed although, as noted above, the flow induced by each of the mixers has a circumferential component in the same relative sense or direction as the other mixers.

Figure 2:
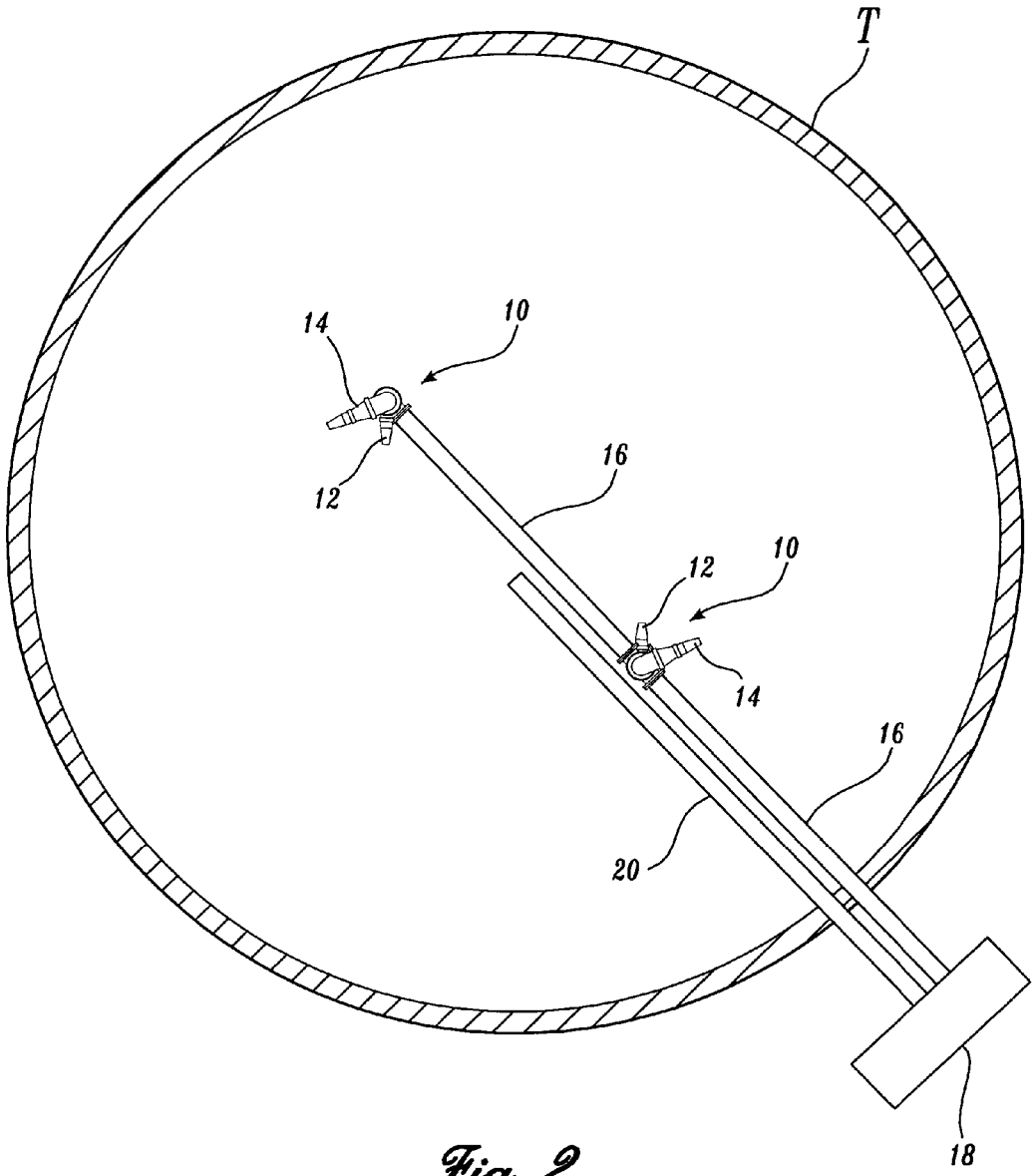
FIG. 2 is a top plan corresponding to FIG. 1 but showing inlet and outlet pipes for a pump located externally of the tank to induce a mixing flow pattern in accordance with the present invention.

Different types of mixers could be used, such as propeller mixers, to induce flow in the indicated directions. However, in the preferred embodiment the mixers are jet nozzles driven by a pump that can be located externally of the tank and have an inlet for drawing slurry from inside the tank. For example, as shown in FIG. 2, the jet mixers 10 can be supplied by the outlet conduit 16 of a centrifugal pump 18, preferably a chopper pump if chunks of solid material are anticipated. Suitable chopper pumps are available from Vaughn Co., Inc., of Montesano, Wash. Conduit 16 extends along the floor of the tank T, although it could be buried in a trench or encased in solid material such as concrete faired or blended into the floor so as not to interfere with a smooth flow. Nevertheless, it should be kept in mind that access to the conduit 16 for maintenance or replacement may be required. The pump inlet conduit 20 can extend to approximately the center of the tank for additional assistance in drawing out solid material that may have gathered there, but in at least some applications the inlet can be quite close to the interior tank wall, preferably toward the bottom.

Figure 3:
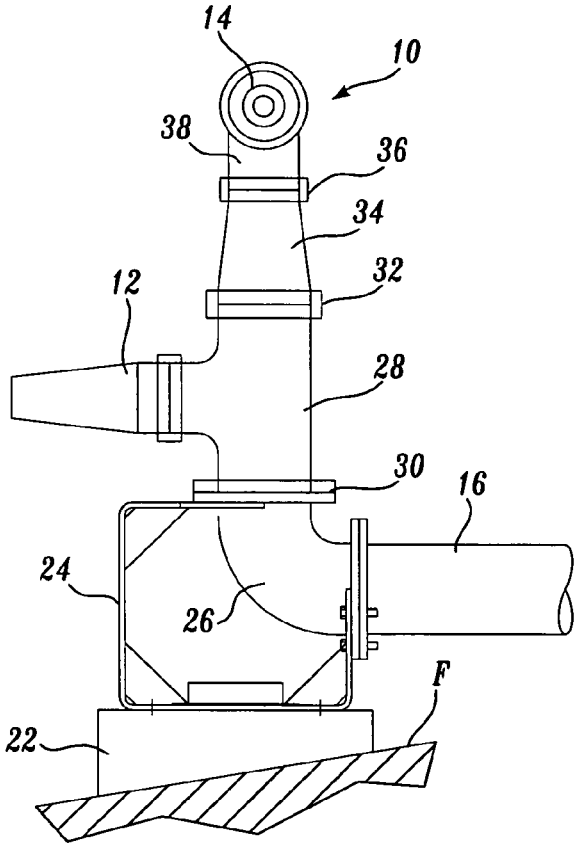
FIG. 3 is a side elevation of a mixer assembly that may be used in the invention.
Figure 4:
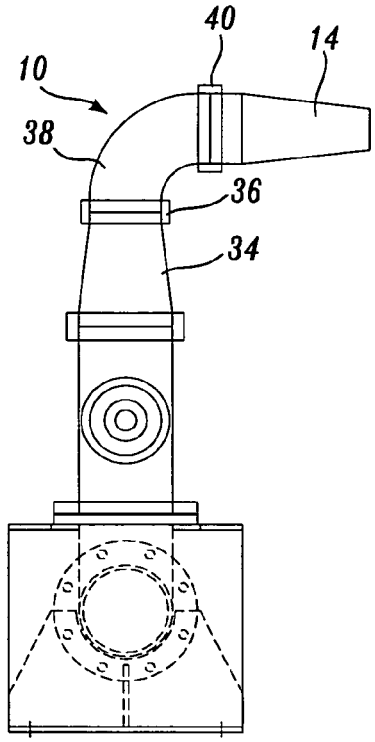
FIG. 4 is an end elevation thereof.
Figure 5:
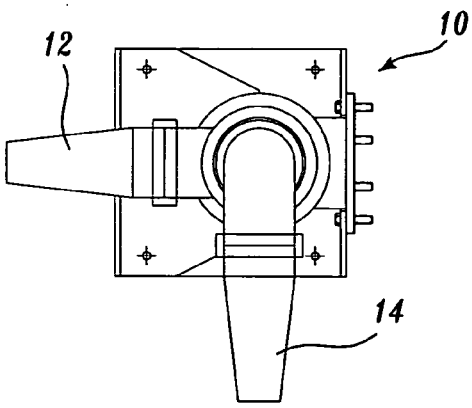
FIG. 5 is a top plan thereof.
Figure 8:
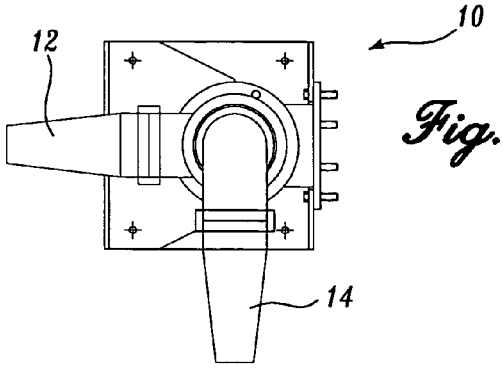
FIGS. 6, 7, and 8 are views corresponding to FIGS. 3, 4, and 5 but showing an alternative embodiment.

It is preferred that the mixer assemblies 10 not be located close to the center of the tank nor close to the outer wall of the tank, and that the individual mixers be submerged well below the median depth of the liquid or slurry in the tank. For an installation in a tank 50 feet in diameter and 20 feet deep, a representative jet nozzle mixer assembly 10 is illustrated in FIGS. 3–5. FIG. 3 shows a mounting block 22 and stabilizer bracket assembly 24 mounted on the block for the pump outlet or discharge pipe 16 which is connected to a 90 degree elbow 26 carried by the bracket assembly 24. The upward directed end of the elbow is connected to a tee 28 from which the lower mixer nozzle 12 branches. The angle of the lower mixer 12 in a horizontal plane is adjustable by means of the coupling 30 between elbow 26 and tee 28. This coupling can be an adjustable "Vic Flange" of the type available from Victaulic Company of Easton. Pennsylvania. As noted above, preferably the lower nozzle 12 is located fairly close to the floor F, such as no more than 3 feet above the floor. A riser may be inserted between the elbow 26 and tee 28 if necessary to achieve a desired height. Both nozzles preferably extend horizontally.

From the upper end of the tee 28, flanged couplings 32 and 36 connect a tapered conduit 34 to an elbow 38 leading to another coupling 40 and the upper mixer nozzle 14. Consequently, the upper nozzles are aligned vertically with the associated lower nozzles. Couplings 32 and 36 permit adjustment of the angular position of the upper mixer nozzle 14.

While spaced above the lower mixer 12, the upper mixer 14 still is located quite far below the median depth of the slurry in the tank. In the embodiment of FIGS. 3–5, the lower nozzle can be positioned about three feet above the floor F, and the upper nozzle approximately 6 feet above the floor. The different sections of the pump outlet conduits 16, the conduits of the mixer assemblies, and the cross-sectional size of the nozzle exits can be sized to achieve approximately equal flow from the mixers at different locations and elevations within the tank.

Depending on the character of the material being treated and the size of the tank (diameter and depth), the nozzles can be located within a central band of the tank, such as within about 25% to about 75% of the radius. Most often, the nozzles will be located somewhat closer to the center of the tank than to the exterior wall. This provides for more turbulent mixing at the center, where solids tend to gather, than at the outside, and increases the overall efficiency of generating a rotational motion of the entire body of slurry in the tank. The angles at which the nozzles induce flow also may be different for different installations, although it is preferred that the upper and lower mixers be pointed at angles no greater than 60 degrees relative to a tangent to the circle c. In other words, angle a should be at least 30 degrees and substantially less than 90 degrees, and angle b should be substantially greater than 90 degrees but no more than 150 degrees, preferably no more than 135 degrees for the upper mixers. Most often the lower mixers will be angled inward to a greater degree than the upper mixers are angled outward, for example, in the range of 45 degrees to 60 degrees inward for the lower mixers and 10 degrees to 30 degrees outward for the upper mixers. Preferably, the circumferential component of at least the upper nozzles will be greater than the outward directed or radial component.

The flow pattern induced by the mixer assemblies can be calculated by computer modeling. In general, at start up turbulence is induced adjacent to the nozzle exits in the respective directions, with the turbulent area gradually widening downstream as the flow through the nozzles is continued. At the same time, circular flow is induced in the adjacent mass of the material in the tank. Within a few minutes after start up, the turbulent cloud blown by the upper nozzles reaches the tank wall and tends to divide upward and downward, reflect off the wall of the tank while still moving circumferentially, and induce flow in a greater and greater mass of the tank both circumferentially and above and below the nozzle centerline. Meanwhile, flow through the lower, inward directed nozzles blasts partly off the bottom of the tank and creates turbulence toward the center while also inducing flow in the same circumferential direction. There is a pattern of turbulence and circular flow at the center, and a pattern of less turbulence and circular flow toward the outside of the tank adjacent to the floor. Ultimately, within about 20 to about 30 minutes after start up, a uniform mixing of the tank solids and liquid is achieved as the body of the material in the tank rotates in the induced direction, with less turbulence adjacent to the nozzle exits as the speed of rotation of the material in the tank increases. The inward directed nozzles still tend to sweep up solids from the center of the tank, adjacent to the floor, and entrain them into the rotational pattern, and the upper nozzles still tend to induce flow toward and against the wall of the tank. In a preferred mixing pattern, the lower nozzles create a significantly greater rate of rotation within the center 30% of the total floor surface area. This higher rate of rotation creates a centrifugal pressure, which is greater than the pressures created from the tank rotation around the periphery of the tank. This phenomenon allows for the solids to be drafted away from the center of the tank and thus prevents the accumulation of solid near the center of the tank that is often called the "tea cup effect." The upper nozzles of each assembly create the necessary rotational speed and wall deflected currents to produce a more uniform dispersion of solids and liquid in a very short period of operational time. This concept can be referred to as a "dual rotational pressure field."

Figure 6:
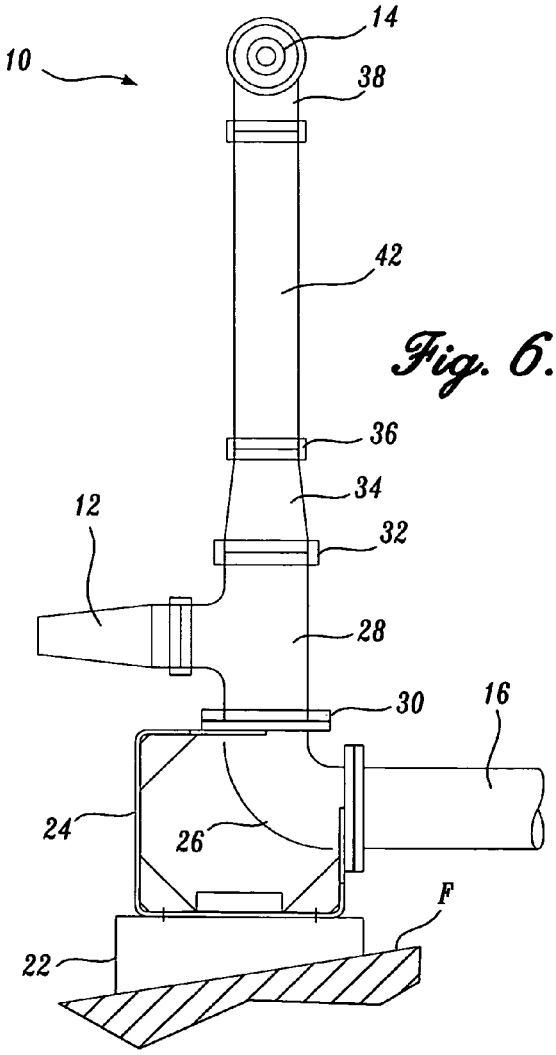
Figure 7:
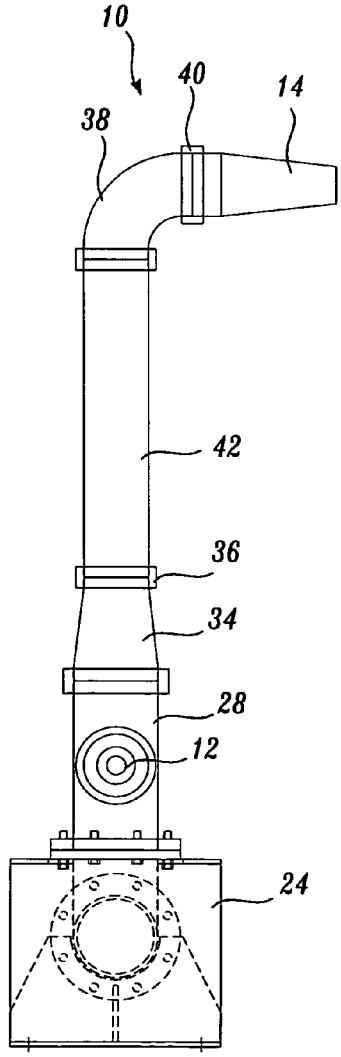
Figure 11:
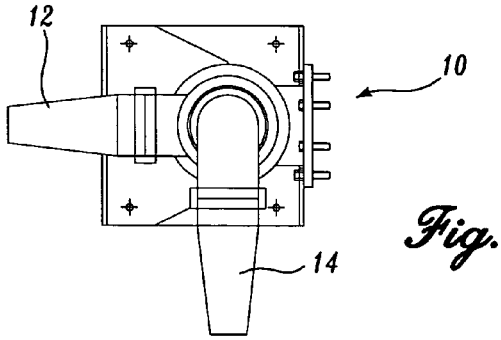
FIGS. 9, 10, and 11 are views corresponding to FIGS. 3, 4, and 5 but showing another embodiment.
Figure 9:
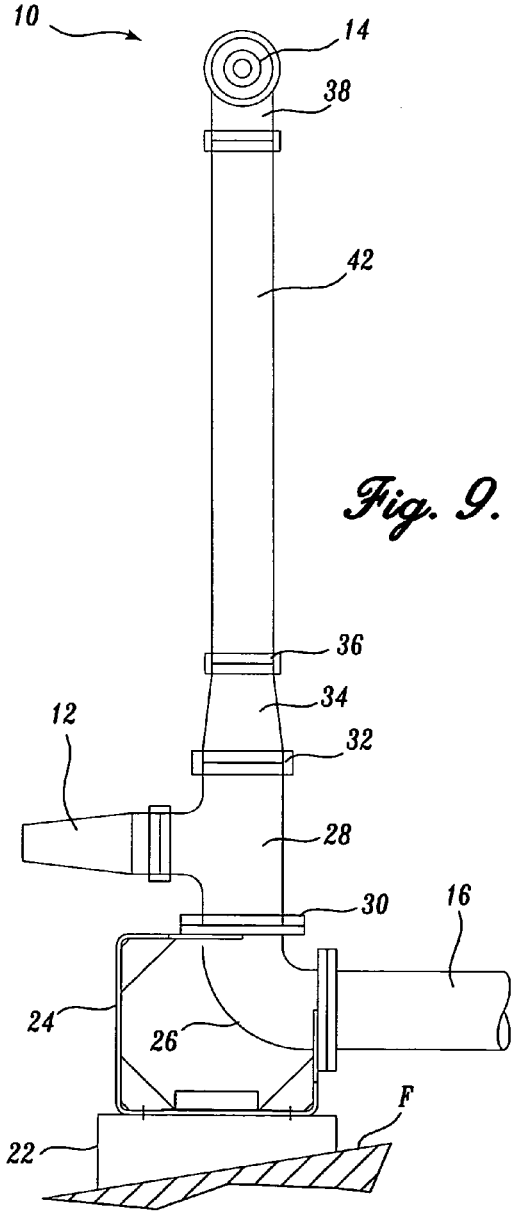
Figure 10:
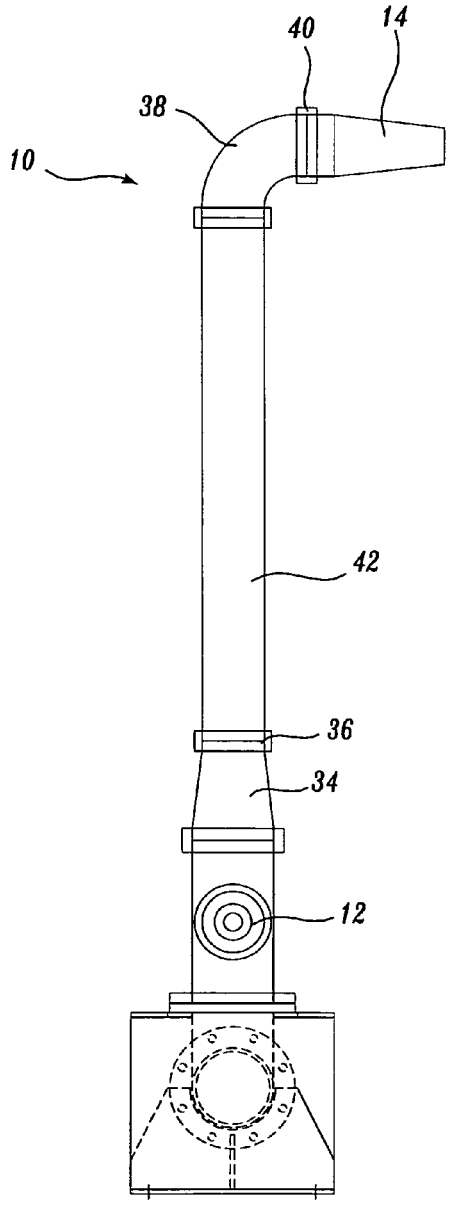

For a specific installation, such as tanks that are very deep relative to their diameter, risers can be used to space the upper nozzles 14 farther above the floor, such as risers 42 as illustrated in FIGS. 6–8 and FIGS. 9–11. In the embodiment of FIG. 6, the height of the upper nozzles 14 is increased to approximately 9 feet and in the embodiment of FIGS. 9–11, the height of the upper nozzles is about 10 feet. Depending on the tank geometry, the height could be 12 feet to 15 feet or more.

In current embodiments, the exit ends of the nozzles are about 1.5 to about 2.5 inches in diameter, but in a representative installation other diameters can be used, such as 1 inch to 4 inches, and the system is designed for an exit velocity of about 35 to about 45 feet per second, about 300 to about 600 gallons per minute per nozzle. The length of each nozzle is preferably several times the exit end diameter. The longer nozzle creates a smooth acceleration through the nozzle to reduce the effects of high flow cavitation within the nozzle. A typical retention time for an anaerobic digester can be about 30 days, with eight hours continuous mixing followed by 16 hours idle. Immediately following mixing, centripetal forces induce solids in the slurry to settle toward the center. In some installations, a "bleed and feed" operation is continued during the retention period, i.e., liquid is drained from the tank while additional waste water/sewage is fed into the tank. Following the idle period, a uniform dispersion of solids and liquid is achieved within about 30 minutes of start-up of the mixing system in accordance with the present invention.

Figure 14:
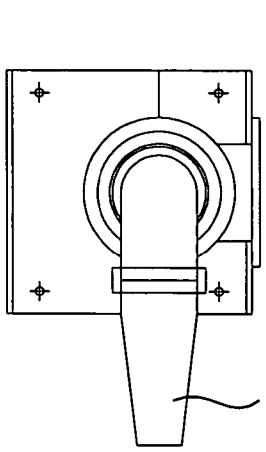
FIGS. 12, 13, and 14 are views corresponding to FIGS. 3, 4, and 5, but showing another embodiment.
Figure 12:
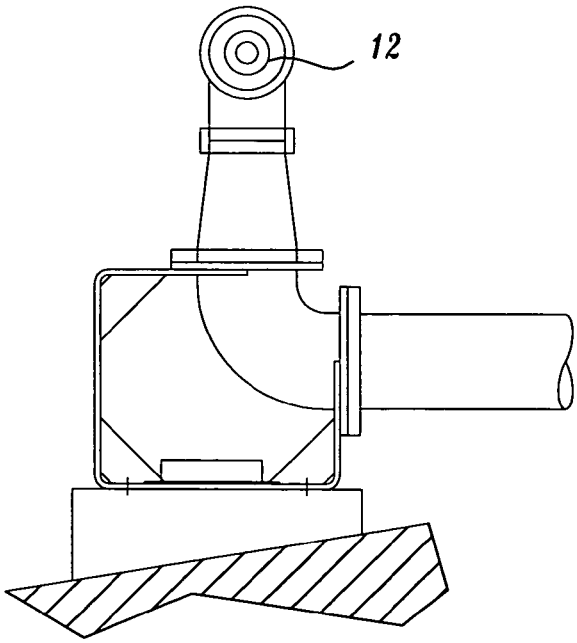
Figure 13:
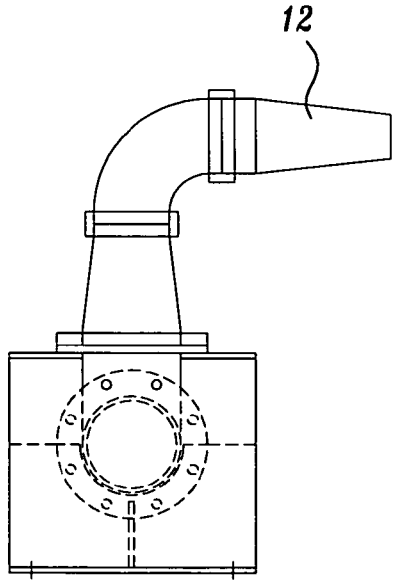

While it is preferred that the upper and lower mixers be disposed at the same locations in the tank, it is possible to separate the upper mixers from the lower mixers. For example, in an installation of the type shown in FIG. 1, the lower mixers could be positioned at locations L so that the upper nozzles are disposed 180 degrees relative to each other and 90 degrees relative to adjacent lower nozzles. In that case, the lower nozzle assemblies would be as shown in FIGS. 12 to 14, and the upper nozzle assemblies would be the same with the exception that a riser would be provided to position them higher above the tank floor.

Figure 15:
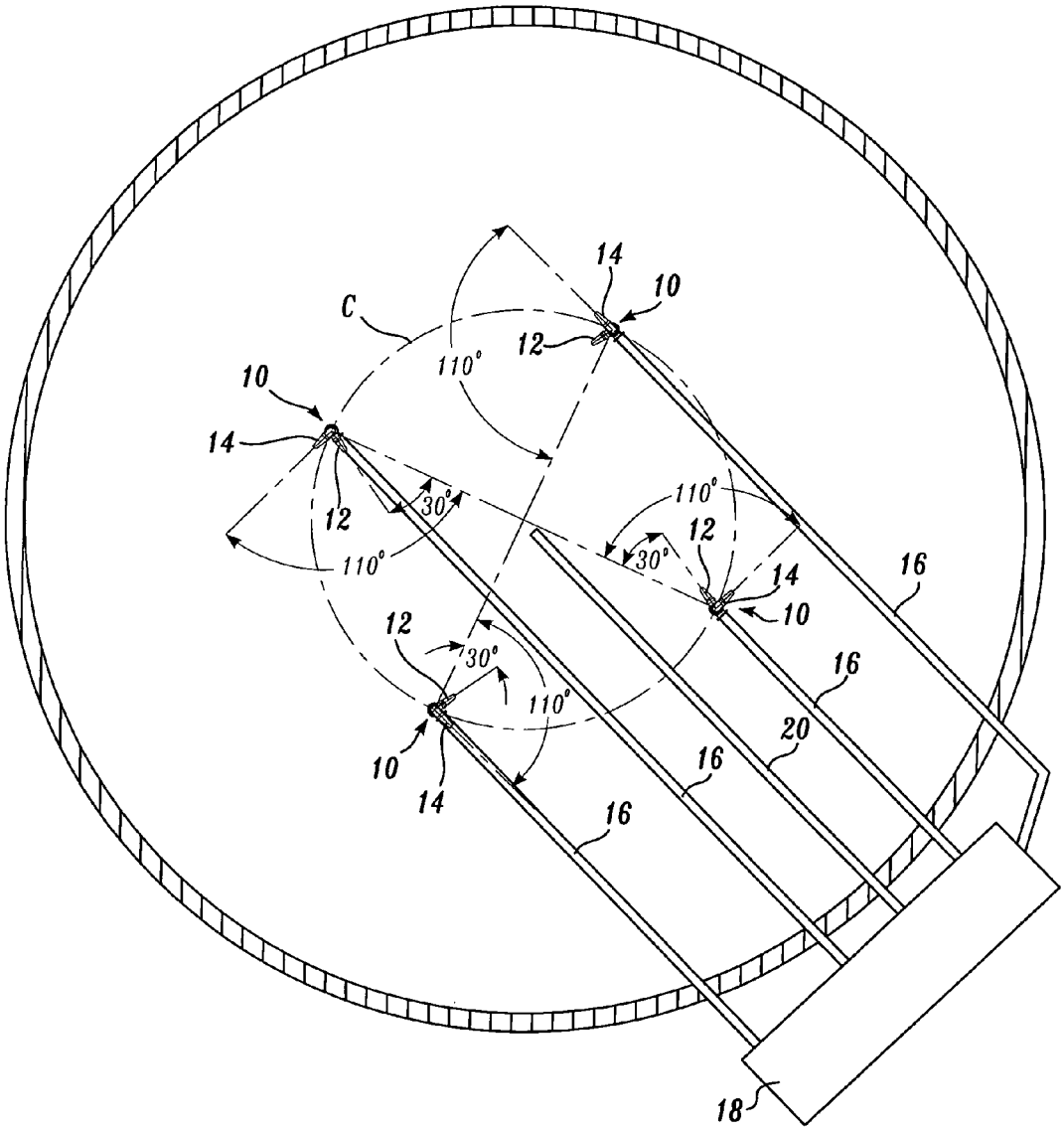
FIG. 15 is a diagrammatic top plan of another storage/treatment tank having a mixing system in accordance with the present invention.

In the embodiment of FIG. 15, four mixer assemblies 10 are provided, each the same radial distance from the center of the tank, i.e., the assemblies all lie on a circle c. Preferably, the assemblies are located at uniform angles around the circumference of the tank, in this case spaced apart 90 degrees relative to adjacent assemblies. This arrangement is more expensive and complicated but may result in quicker mixing. In the embodiment of FIG. 15, each nozzle assembly is fed separately from an outlet conduit 16 from the pump-valving system 18 located externally of the tank, and the pump-valving system is fed by an inlet conduit 20 that extends to the center of the tank. Also, the lower nozzles are angled more sharply inward, 30 degrees relative to a radius, and the upper nozzles are angled less severely outward, 110 degrees relative to the radius or only 20 degrees relative to a tangent to circle c intersecting the associated mixer assembly 10. Otherwise, the overall effect achieved is the same as that described above, with the mixer assemblies 10 being positioned in a band at least about 25% to about 75% of the radius of the tank, preferably more toward the center of the tank than toward the exterior wall.

Figure 16:
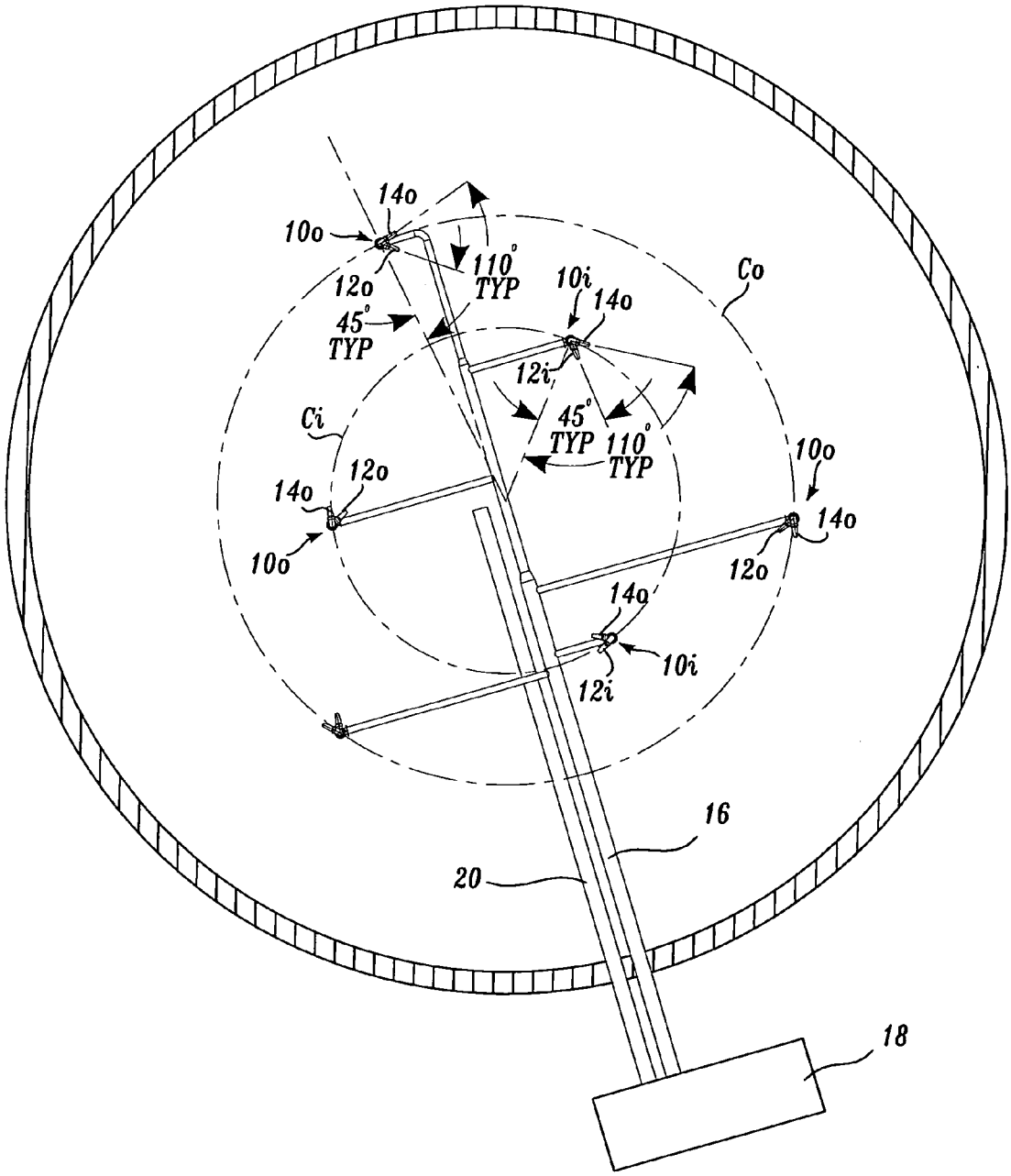
FIG. 16 is a diagrammatic top plan of another storage/treatment tank having a mixing system in accordance with the present invention.

Another arrangement is illustrated in FIG. 16 where six mixer assemblies 10*o* and 10*i* are provided, assemblies 10*o* being spaced uniformly around an outer circle co and the inner assemblies 10*i* being uniformly spaced around an inner circle ci. This arrangement is appropriate for tanks of very large diameter, such as 80 feet or more, but the overall system still is designed for approximately equal flow from each mixer. The inner, bottom mixers 12*i* are angled inward at about 45 degrees as are the outer bottom mixers 12*o*. All upper mixers 14*i* and 14*o* are angled outward at about 100 degrees. The outlet conduit 16 from the pump system 18 and the branches to the various mixers are sized for equal flow. Intake to the pump can be by a conduit 20 extending to the center of the tank adjacent to the floor, or from an outer portion of the tank. Again, the lower nozzles 12*i* and 12*o* entrain and push solids at the bottom into the rotational flow, and the upper nozzles 14*i* and 14*o* assist in maintaining the rotational mixing pattern for the body of slurry within the tank. For a particular installation, computer modeling can be used to assure that a minimum of 90% active mixing will occur within 30 minutes or less if the application is for an anaerobic digester.

While the preferred embodiment of the invention has been illustrated and described, it will be appreciated that various changes can be made therein without departing from the spirit and scope of the invention. For example, the lower mixers can be located at different distances from the center of the tank than the upper mixers so long as substantially the same flow pattern is achieved. Common locations have been found to be effective both in creating the desired flow pattern and economy and simplicity of construction. Also, although described with reference to the preferred jet nozzle mixers, other types of mixers could be used. Jet nozzles are believed to decrease the prospects of solid materials being trapped on, adhered to, or wrapping around the mixers.

The invention claimed is:

1. In a tank having a floor, a center, and a peripheral wall, the tank containing a quantity of nonhomogeneous material including a liquid having a median depth in the tank, and apparatus for mixing the nonhomogeneous material, the improvement comprising the mixing apparatus including a plurality of first jet nozzles for inducing flow of liquid within the tank, the first nozzles being located a substantial distance outward from the center of the tank and a substantial distance inward from the peripheral wall of the tank, the first nozzles being equidistant from the center of the tank, and a plurality of second jet nozzles for inducing flow of liquid within the tank, the second nozzles being located a substantial distance outward from the center of the tank and a substantial distance inward from the peripheral wall of the tank, the second nozzles being equidistant from the center of the tank, each of the first nozzles inducing flow of liquid in a first direction circumferentially of the tank, each of the second nozzles inducing flow of the liquid in the first direction circumferentially of the tank, the first nozzles being directed at least partly inward relative to a tangent to a circle centered about the center of the tank which circle intersects the locations of the first nozzles and the first nozzles being directed inward relative to the second nozzles, each first nozzle being approximately aligned vertically in the tank with one of the second nozzles, each first nozzle being adjacent to the floor, and each second nozzle being raised above the floor at an elevation higher than the first nozzles.

2. In the tank defined in claim 1, each first nozzle being angled inward at an angle between 45 degrees and 60 degrees, and each second nozzle being angled outward at an angle between 10 degrees and 30 degrees.

3. In the tank defined in claim 1, each of the first and second nozzles being positioned closer to the center of the tank than to the peripheral wall of the tank.

4. In the tank defined in claim 1, the first and second nozzles inducing approximately equal flows.

5. In the tank defined in claim 1, each of the first and second nozzles being located below the median depth of liquid.

6. The method of mixing material in a tank having a floor, a center, and a peripheral wall, the tank containing a quantity of liquid having a median depth, which method comprises:

using a first jet nozzle to induce a first flow of liquid in the tank at a location adjacent to the tank floor, a substantial distance outward from the center and a substantial distance inward from the peripheral wall, in a first direction circumferentially of the tank; and using a second jet nozzle aligned vertically with but higher than the first nozzle to induce a second flow of liquid in the tank at a location substantially higher than the first flow, the second flow being in the first direction circumferentially of the tank, the first flow being directed at least partly inward relative to a tangent to a circle centered about the center of the tank which circle intersects the first jet nozzle, and the first flow being directed inward relative to the second flow.

* * * * *